US006389253B1

(12) United States Patent
Nonomura et al.

(10) Patent No.: US 6,389,253 B1
(45) Date of Patent: May 14, 2002

(54) IMAGE FORMING APPARATUS FEATURING A REGULATING MEMBER FOR REGULATING A NUMBER OF LAYERS OF A DEVELOPER CARRIED BY A DEVELOPER CARRYING MEMBER

(75) Inventors: Makoto Nonomura, Kawasaki; Yukihiro Ozeki, Yokohama; Katsuhiro Sakaizawa, Numazu; Manami Sekiguchi, Mishima, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/629,868

(22) Filed: Aug. 1, 2000

(30) Foreign Application Priority Data

Aug. 4, 1999 (JP) ..... 11-221219

(51) Int. Cl.[7] ..... G03G 15/30; G03G 21/00
(52) U.S. Cl. ..... 399/149; 399/357
(58) Field of Search ..... 399/149, 343, 399/356, 357

(56) References Cited

U.S. PATENT DOCUMENTS 5,915,150 A * 6/1999 Kukimoto et al. ..... 399/149
5,970,279 A * 10/1999 Sakaizwa et al. ..... 399/149 X
6,021,293 A * 2/2000 Anno et al. ..... 399/149 X

* cited by examiner

*Primary Examiner*—Fred L Braun
(74) *Attorney, Agent, or Firm*—Fitzpatrick, Cella, Harper & Scinto

(57) ABSTRACT

An image forming apparatus includes an image bearing member for bearing an electrostatic latent image, and a developing device for developing the electrostatic latent image with a developer and collecting the developer remaining on the image bearing member including a developer carrying member for carrying the developer. The developer carried by the developer carrying member comes into contact with the image bearing member as the developer carrying member moves and a regulating member for regulating a layer thickness of the developer carried by the developer carrying member. The regulating member regulates the layer thickness of the developer carried by the developer carrying member so that there will be three to eight layers, wherein V2/V1>1.54 holds where V1 is a peripheral velocity of said image bearing member and V2 is a peripheral velocity of said developer carrying member.

12 Claims, 5 Drawing Sheets

IMAGE FORMING APPARATUS FEATURING A REGULATING MEMBER FOR REGULATING A NUMBER OF LAYERS OF A DEVELOPER CARRIED BY A DEVELOPER CARRYING MEMBER

BACKGROUND OF THE INVENTION

1. Field of the Invention

The present invention related to an image forming apparatus based on electrophotography or electrophotographic recording used, for example, for printers or copiers. In particular, it relates to an image forming apparatus that utilizes a so-called cleaning process simultaneously with developing.

2. Related Background Art

FIG. 6 shows an example of a conventional image forming apparatus. This image forming apparatus is configured by developing images with a one-component developer placed in contact with an image bearing member bearing electrostatic latent images. It does not have any separate cleaning mechanism and it uses the developing device to clean the residual toner on the image bearing member by the so-called cleaning process simultaneous with developing. This conventional image forming apparatus will be described below briefly with reference to FIG. 6.

This image forming apparatus comprises a photosensitive drum 101 which is an image bearing member for holding electrostatic latent images, exposing means 102 for recording electrostatic latent images on the photosensitive drum 101, a developing device 103 for developing the electrostatic latent images on the photosensitive drum 101 as well as for collecting any residual toner that was not transferred to the transferring material and cleaning its history, a transfer roller 104 which is transfer means for transferring the toner images developed on the photosensitive drum 101 to the transferring material, a heat roller 105 which is fixing means for fixing the toner images transferred to the transferring material, etc.

On this image forming apparatus, images are formed as follows. First, image information is recorded as an electrostatic latent image on the photosensitive drum 101 by the exposing means 102. The electrostatic latent image on the photosensitive drum 101 is visualized as a toner image, being developed by the developer supplied by the developing device 103 placed in abutment with the photosensitive drum 101, under the action of the developing electric field generated by a power supply not shown. The toner image is transferred to the transferring material under the action of the transfer electric field generated between the photosensitive drum 101 and transfer roller 104 and is fixed on the transferring material under the heat and pressure applied by the heat roller 105. The remainder of the toner image (residual toner) that was not transferred to the transferring material and left on the photosensitive drum 101 is brought into abutment with the developing device 103 again and collected to the developing device 103 for reuse under the action of the developing electric field described above.

At the time of developing electrostatic latent images in the image formation process described above, elastic bodies such as rubber rollers and sponge rollers are used for the developer carrying member 111 provided in the developing device 103 because the developer is brought into contact with the photosensitive drum 101.

FIG. 7 shows an enlarged view of the developing device 103.

The developing device 103 mainly comprises a developing roller 111 which is a developer carrying member for carrying a one-component developer on its surface and which rotates in the direction of the arrow in the figure, a regulating blade 112 which is a developer regulating member for regulating the developer, a feed roller 113 which serves both as developer supply means for supplying the developer to the developing roller 111 rotating in the direction of the arrow in the figure and as developer recovery means for collecting the developer not used for developing, an agitating paddle 114 for agitating and carrying the developer, a spout-proofing sheet 115 for preventing the developer from scattering from the lower part of the developing roller 111, and a developer container 116 for housing the developer.

Now, the operation of the developer 103 will be described.

The developer housed in the developer container 116 is carried to the area R near the developing roller 111 and feed roller 113 by the agitating paddle 114. The developer carried there is homogenized by being made denser once in the area R with the rotation of the feed roller 113. Then it si given a charge by the frictional electrification resulting from rubbing with the developing roller 111 and feed 113 counterrotating in abutment with each other.

The developer given a charge in this way is supplied to the developing roller 111 by the reflection force received from the developing roller 111 through the acquired charge. Thin layers of the developer are applied to the developing roller 111 under the regulation of the regulating blade 112 pressed against the developing roller 111. In this way, the charge for developing is given by the frictional electrification with respect to the surfaces of the developing roller 111 and blade 112.

Through these actions, thin layers of charged developer are applied to the developing roller 111 for use in developing. The developer applied to the developing roller 111 but not used for developing is scraped off the developing roller 111 by the feed roller 113. Part of it is supplied again to the developing roller 111 by the feed roller 113 together with fresh toner and the rest is returned to the developer container 116.

On the other hand, the photosensitive drum 101 is placed in abutment with the developing roller 111 and thus the developer applied to the developing roller 111 is used for developing while being in contact with the photosensitive drum 101. A power supply not shown is connected between the photosensitive drum 101 and developing roller 111 so as to form a developing electric field. The developer applied to the developing roller 111 is transferred to the electrostatic latent image borne on the photosensitive drum 101 under the action of this electric field to develop the image.

At the same time, in the abutment area between the photosensitive drum 101 and developing roller 111, the residual toner produced as a result of the image formation is collected. The residual toner in the abutment area is transferred to the developing roller 111 by the developing electric field acting strongly between the very closely located photosensitive drum 101 and developing roller 111. There the residual toner is collected.

The image formation process proceeds through the sequence of actions described above.

However, the image forming apparatus described above, where electrostatic latent images are developed with the one-component developer carried on the developing roller 111 kept in contact with the photosensitive drum 101, is liable to produce image fog because toner that is contained in the developer carried by the developing roller 111 and that is charged insufficiently (uncharged toner) or charged oppositely (reverse toner) to the desired polarity will cling to the background and part of it will be transferred to the transferring material.

On the other hand, it is possible to reduce image fog by making the layers of developer applied to the developing roller 111 very thin and allowing sufficient frictional electrification, the history of previous image formation or so-called ghost may appear if the cleaning process simultaneous with developing is used. This will be described in detail below.

According to studies conducted by the inventors, if the layers of the developer carried on the developing roller 111 are made very thin, sufficient frictional electrification can decrease uncharged toner or reverse toner and thus reduce image fog. However, it was found that since very thin layers of developer are applied to the developing roller 111, the history generated by the residual toner collected during the cleaning process simultaneously with developing would appear as local variations in the amount of developer carried on the developing roller 111, resulting in a ghost during the developing process going on simultaneously.

Also, this type of ghost tends to become prominent as the image fog decreases. This is because when images are fogged badly, a great amount of fog-causing toner clings to the background, burying residual toner in the noise on the background and thus preventing the history of the residual toner from standing out alone.

Furthermore, the toner collected during the cleaning process simultaneous with developing has undergone functional deterioration under the load involved in the sequence of image formation processes and part of it is accumulated in the developing device without reuse, causing functional deterioration of the members composing the developing device. Therefore, it is desirable that the absolute amount of the toner collected is small, for example, in order to speed up image formation or prolong the life of the apparatus. In this respect, it is indispensable to reduce uncharged toner or reverse toner that will cause image fog.

In other words, there is the problem that in the performing cleaning process, simultaneously with developing where thin layers of a one-component developer are applied the developing roller 111 and the developer and the developing roller 111 are placed in contact with the photosensitive drum 101, it is not easy to reduce image fog and ghosts. This in turn presents the problem that it is not easy to speed up image formation or prolong the life of the apparatus while maintaining good image formation.

SUMMARY OF THE INVENTION

An object of the present invention is to provide an image forming apparatus that will allow good image formation.

Another object of the present invention is to simultaneously reduce image fog and ghosts and provide an image forming apparatus capable of maintaining good image formation for an extended period of time.

Still another object of the present invention is to provide an image forming apparatus, comprising an image bearing member for bearing an electrostatic latent image; and developing means for developing the electrostatic latent image with a developer and collecting the developer remaining on the image bearing member, including a developer carrying member for carrying the developer wherein the developer carried by the developer carrying member comes into contact with the image bearing member as the developer carrying member moves, and a regulating member for regulating a layer thickness of the developer carried by the developer carrying member wherein the regulating member regulates the layer thickness of the developer carried by the developer carrying member so that there will be three to eight layers.

Other objects and features of the present invention will be more apparent by reference to the following detailed description taken in connection with the accompanying drawings.

BREIF DESCRIPTION OF THE DRAWINGS

DESCRIPTION OF THE PREFERRED EMBODIMENTS

An image forming apparatus related to the present invention will be described in detail below with reference to drawings.

Embodiment 1

Figure 2:
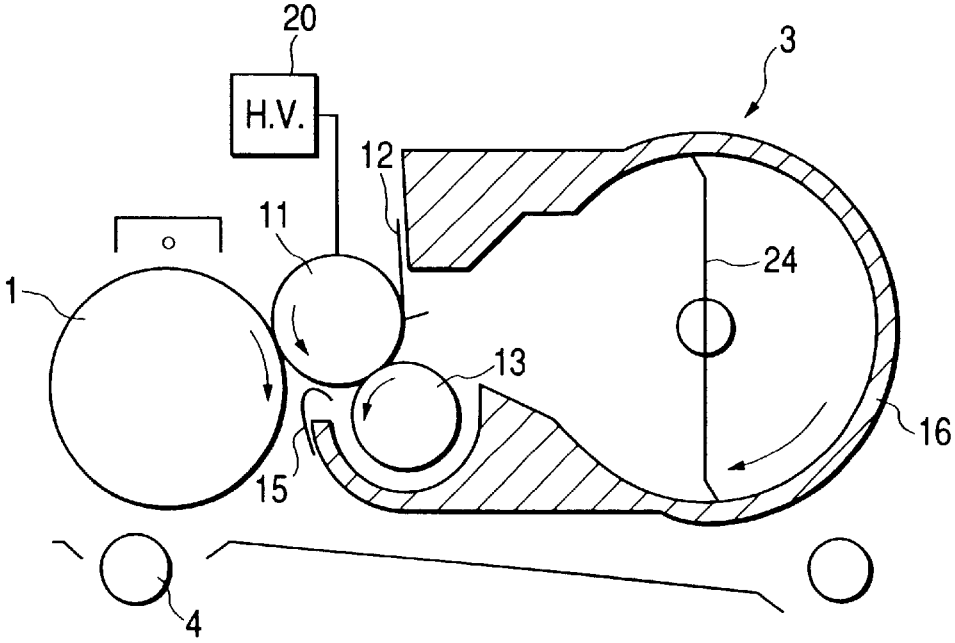
FIG. 2 is a schematic block diagram showing a developing device according to the first embodiment.
Figure 3:
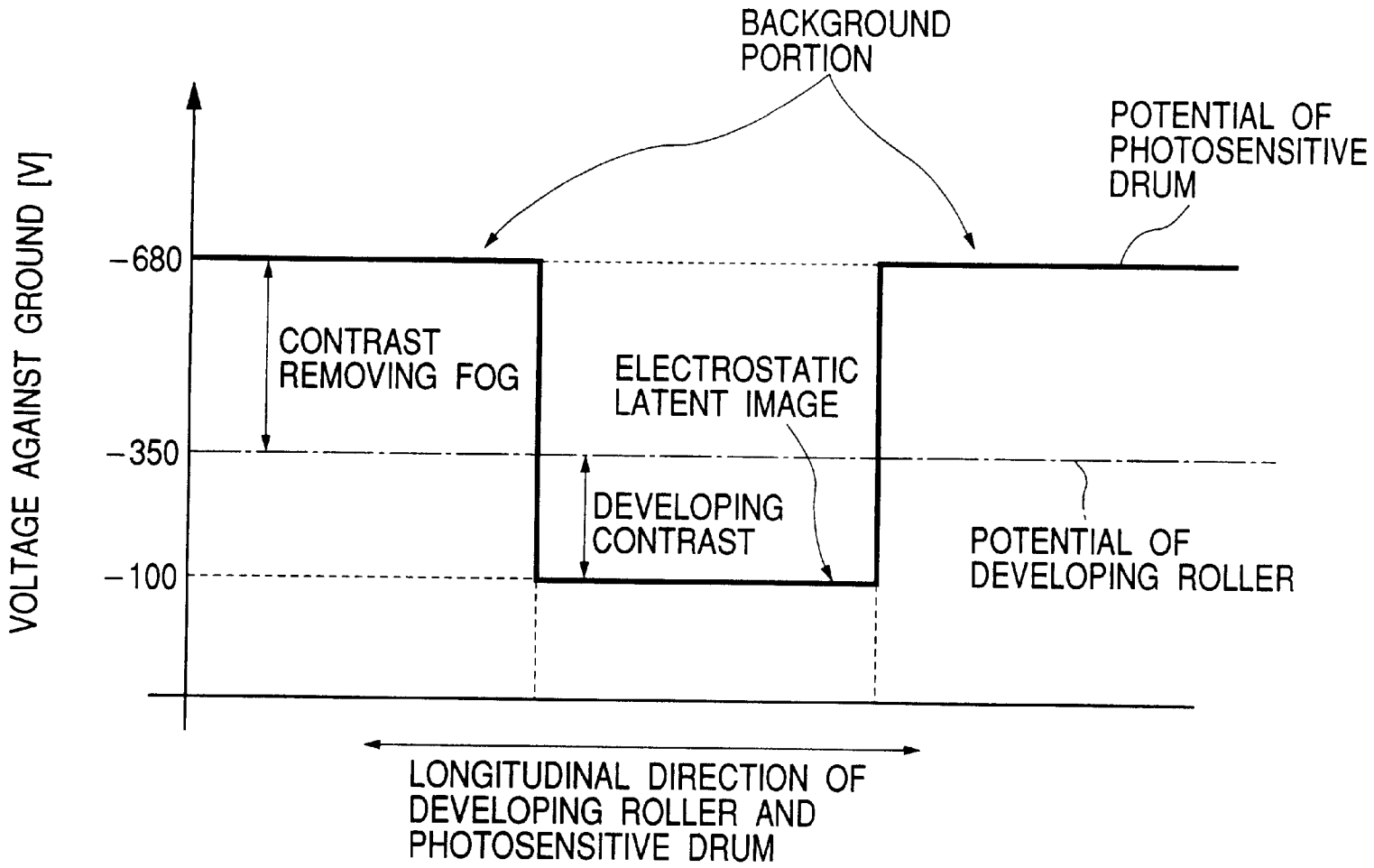
FIG. 3 is an explanatory drawing showing the ranking of a potentials of a photosensitive drum, residual toner, and developing roller in a cleaning process simultaneous with developing.

A first embodiment of the present invention will be described with reference to FIGS. 2 to 4. An image forming apparatus according to this embodiment forms images by a one-component contact developing method using a cleaning process simultaneously with developing.

Figure 1:
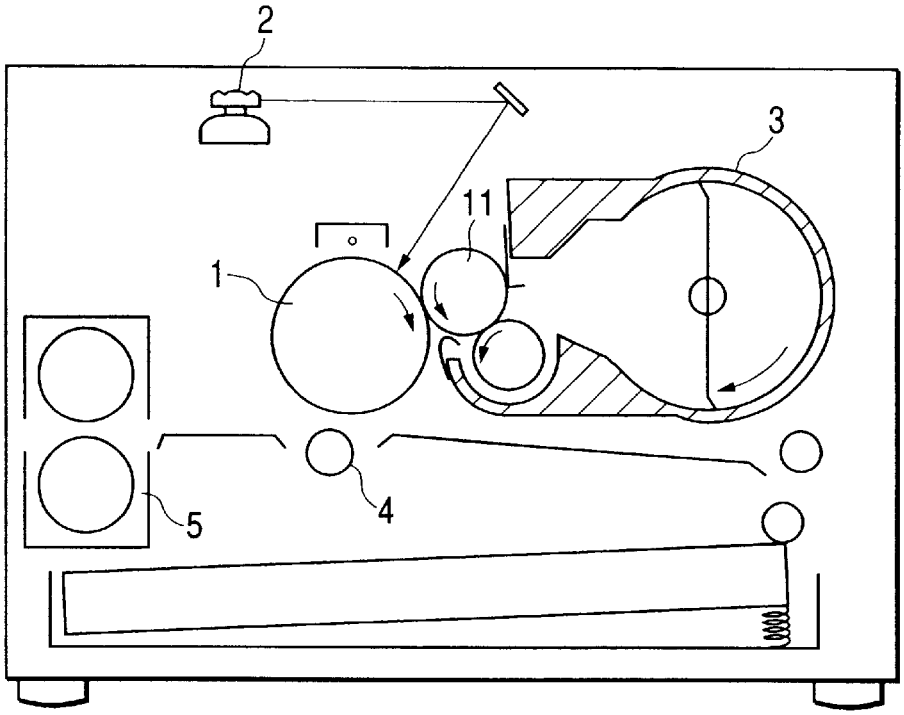
FIG. 1 is a schematic block diagram showing an image forming apparatus according to a first embodiment.

First, the image forming apparatus according to this embodiment will be described with reference to FIGS. 1 and 2. As shown in FIG. 1, it comprises a photosensitive drum 1 which is an image bearing member for holding electrostatic latent images, exposing means 2 for recording electrostatic latent images on the photosensitive drum 1, a developing device 3 for developing the electrostatic latent images on the photosensitive drum 1 as well as for collecting any residual toner that was not transferred to the transferring material and cleaning its history, a transfer roller 4 which is transfer means for transferring the toner images developed on the photosensitive drum 1 to the transferring material, a heat roller 5 which is fixing means for fixing the toner images transferred to the transferring material, etc.

In the process described above, image information is recorded first as an electrostatic latent image on the photosensitive drum 1 by the exposing means 2. The electrostatic latent image on the photosensitive drum 1 is visualized as a toner image, being developed by the developer supplied by the developing device 3 placed in abutment with the photosensitive drum 1, under the action of the developing electric field generated by a power supply 20 which serves as electric field generation means. The toner image is transferred to the transferring material under the action of the transfer electric field generated between the photosensitive drum 1 and transfer roller 4 and is fixed on the transferring material under the heat and pressure applied by the heat roller 5. The residual toner that was not transferred to the transferring material and left on the photosensitive drum 1 is brought into abutment with the developing device 3 again and collected to the developing device 3 for reuse under the action of the developing electric field described above.

With the image forming apparatus according to this embodiment, the image formation speed, i.e., the drive speed of the photosensitive drum 1 is 50 to 100 mm/sec in terms of peripheral speed. Being placed in contact with the photosensitive drum 1, the developing roller 11 or the developer carrying member in the developing device 3 rotates at 160 to 190% the peripheral speed of the photosensitive drum to form toner images by reversal developing.

Now the developing device 3 will be described with reference to FIG. 2.

Figure 7:
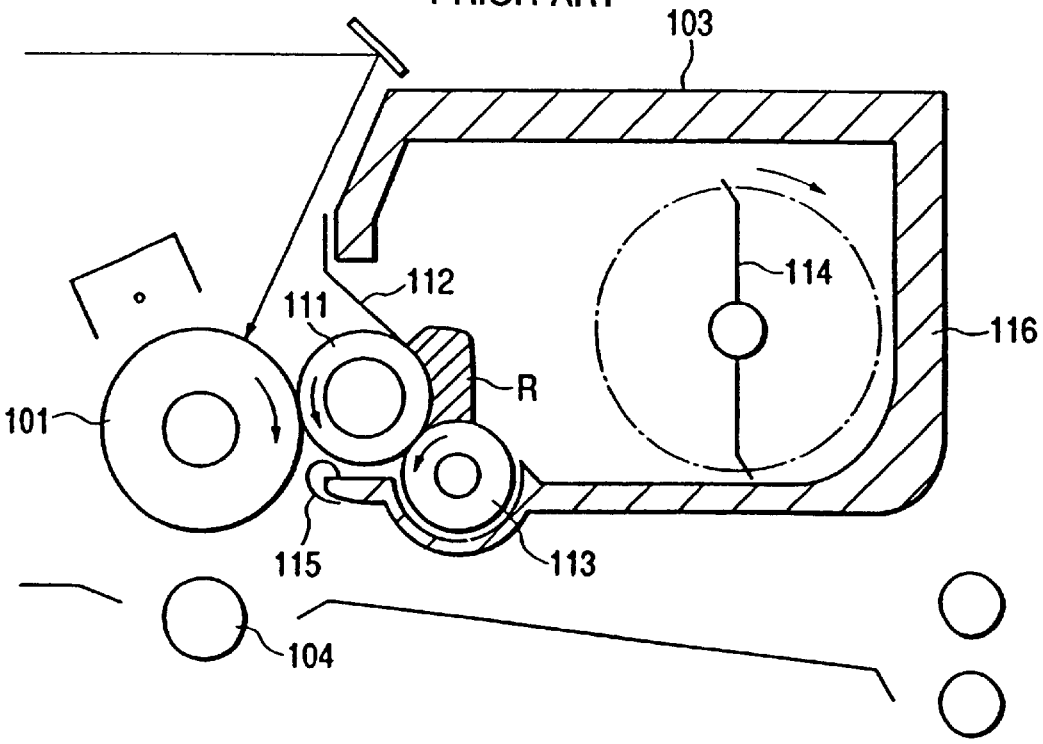
FIG. 7 PRIOR ART
FIG. 7 is an enlarged view showing a developing apparatus of the image forming apparatus shown in FIG. 6.

The developing device 3, which uses a one-component developer employing a nonmagnetic toner, comprises the developing roller 11 that consists of an elastic body and rotates in the direction of the arrow in the figure; a regulating blade 12 that, being placed in abutment with the developing roller 11, serves as a developer regulating member for regulating the amount of developer on the developing roller 11 and giving a charge to the developer by means of frictional electrification; a feed roller 13 that, being placed in abutment with the developing roller 11 and rotating in the direction of the arrow in the figure, serves as developer supply means for applying toner to the developing roller 11 and collecting any developer not used for developing; an agitating member 24 for agitating and carrying the developer; a spout-proofing sheet 15 for preventing the developer from scattering from the developing device 3; and a developer container 16 for housing the one-component developer. It operates in a manner similar to the developing device of the conventional image forming apparatus shown in FIG. 7.

The developer used by the present developing device 3 is a one-component developer consisting mainly of a negatively-chargeable nonmagnetic toner as shown below.

The nonmagnetic toner used here has a particle size in volume average 6 to 8 $\mu$m. It is produced by a so-called "pulverization process" as follows. A resin, release agent made of a substance with a low softening point, coloring agent, charge control agent, etc. are kneaded and dispersed uniformly by a pressure kneader, an extruder, or a media disperser, then the kneaded product is pulverized to a desired particle size in volume average either mechanically or by impingement in a jet stream onto a target, and a desired particle size in volume average distribution is obtained through classification. Of course, it is possible to use a toner produced by any other process including a polymerization process.

The volumetric average particle size in volume average of toner as referred to here is calculated by the following measuring method.

Measurements are taken by Coulter Counter Model TA-II (manufactured by Coulter Electronics, Inc.). Number average distribution and volumetric average distribution are output via an interface (manufactured by Nikkaki K.K.) to a personal computer used for data processing.

Measurements are taken as follows.

An aqueous solution (1 wt %) of NaCl is prepared as an electrolytic solution using first-grade sodium chloride. 0.1 to 5 ml of a surface active agent, preferably an alkylbenzene sulfonate, is added to 100 to 150 ml of the aqueous electrolytic solution, 0.5 to 50 mg of a specimen is added further, and the solution is dispersed. The electrolytic solution with the specimen suspended in it is dispersed for about 1 to 3 minutes on an ultrasonic dispersion machine. Then the particle-size distribution is measured on Coulter Counter Model TA-II to determine the volume distribution, using an aperture of 100 $\mu$m and a particle distribution range of 2 to 40 $\mu$m.

The volumetric average diameter of the sample is calculated based on the volume distribution measured by the above procedures.

The developing roller 11 is a semiconductive elastic roller of an outer diameter of 20 mm consisting of a SUS (stainless steel) core bar having an outer diameter of 12 mm covered with an elastic layer which is made of semi-hard rubber-like material or foam, such as silicon or urethane, or a combination of them and which is mixed with conductive material such as carbon. Its actual resistance is $10^3$ to $10^9\Omega$.

To ensure secure and uniform contact with the photosensitive drum 1 for stable developing and cleaning performance, the developing roller 11 should have a JIS-A hardness of 30 to 40 degrees. Soft rollers made of foam, in particular, desirably have an Asker C hardness of 40° or less.

If the hardness of the roller exceeds this range, the abutting pressure of the two abutting bodies should be increased to ensure uniform abutment with the photosensitive drum 1. This is not desirable, however, because the increased load on the toner resulting from this abutment tends to degrade the performance of the developing roller 11 and regulating blade 12. Besides, the elastic layer of the developing roller 11 is desirably at least 2 mm thick. If it is less than 2 mm thick, the deformation of the elastic layer in the abutment area will be hampered, which in turn tends to result in nonuniform abutment: this is not desirable.

In addition, in order to control the tendency of the developing roller surface to charge the toner or reduce the adhesion of the toner it is also desirable to provide a coating of, for example, polyamide-based resin, fluorine-based resin, urethane-based resin, PMMA, silicon resin, silica; metal oxide such as titanium oxide, aluminum oxide, tin oxide, strontium titanate, zinc oxide, or magnesium oxide; nitride such as silicon nitride; carbide such as silicon carbide; carbon isotope such as carbon black or graphite; metal salt such as calcium sulfate, barium sulfate, or calcium carbonate; or metal salt of fatty acid.

Also, it is desirable that the developing roller surface should have an appropriate surface roughness to increase its tendency to charge the toner and ensure stable transportation of the developer. In addition, the present apparatus has been configured to disturb the history of residual toner by rubbing the photosensitive drum 1 with the developing roller 11 and the developer carried by it during the cleaning process simultaneous with developing. Therefore, to increase the uniformity of the history disturbance, the developing roller surface has a certain surface roughness so that its surface irregularities will be equal to or slightly smaller than those of the toner.

Specifically, when the volumetric average diameter of the toner used is in the range between 1 to 10 $\mu$m, the surface roughness is specified by the ten-point average roughness Rz and maximum height Rmax as defined by JIS-B0601. Rz should be in the range within 5 to 10 $\mu$m and Rmax should be 15 $\mu$m or less.

A ten-point average roughness Rz that is smaller than this range is not desirable because the transportation of the developer becomes unstable, making it difficult to carry the toner on the developing roller 11 maintaining the required layer thickness described later as well as because the rubbing force acting on the photosensitive drum 1 is not sufficient, which may result in insufficient disturbance of the toner history. A ten-point average roughness Rz that is larger than this range is not desirable either because toner remains buried in surface irregularities, hindering frictional electrification and thus reducing the tendency of the surface to charge the toner. This increases the amount of uncharged toner and reverse toner. Besides, rubbing marks are produced when the photosensitive drum is rubbed. Incidentally, rubbing marks are prone to appear when the maximum being Rmax exceeds the range described below.

The surface roughness described above was measured by surface roughness tester SE-30H (manufactured by Kosaka Laboratory Ltd.)

The regulating blade 12 described above is an L-shaped SUS plate spring placed in such a way that the edge of the L-shape will abut the developing roller 11, as shown in the figure. It ensures that the developer carried on the developing roller 11 will be provided as layers of required thickness to the cleaning process simultaneous with developing. Specifically, the regulating blade 12 according to this embodiment is set by the shape of the plate spring in the abutment area, elasticity (Young's modulus) of the spring, and deformation of the spring so that the developer will form 3 to 8 layers.

By measuring the number of layers actually under a confocal optical microscope, the inventors found that the thin layers of developer carried on the developing roller 11 are almost in the closest-packed state and that the layer thickness h [$\mu$m] is given approximately by $$h=(0.82N+0.17)\times r$$

where r [$\mu$m] is the volumetric average diameter of toner used in the developer and N is the number of layers. Therefore, instead of measuring the actual number N of layers, it is possible to measure the layer thickness [$\mu$m] of the developers carried on the developing roller 11 under a confocal optical microscope or the like and set the regulating blade 12 so that the required layer thickness can be obtained, based on the layer thickness calculated by this approximate expression.

The material and shape of the carried member can be replaced by other material and shape as long as proper abutment with the developing roller is secured.

The photosensitive drum 1, an image bearing member, is placed in contact with the developing roller 11 in the developing device 3 described above. When the developing roller 11 deforms due to its elasticity, the photosensitive drum 1 forms an abutting nip in the area of contact with the developing roller 11 in order for the electrostatic latent image on the photosensitive drum 1 to be developed under the action of the developing electric field. At the same time, the transfer-residual toner left over after the image formation is transferred to the developing roller 11 and collected under the action of the developing electric field and by mechanical rubbing by the developing roller 11. This cleans the developing roller 11.

Adding some explanation about a concrete developing electric field, the photosensitive layer on the photosensitive drum 1 has a voltage of −100 V with respect to the ground in the electrostatic latent image portion and a voltage of −680 V with respect to the ground in the background portion. On the other hand, a voltage of −350 V with respect to the ground is applied to the developing roller 11 by the power supply 20, resulting in the ranking of potentials as shown in FIG. 3. Specifically, with respect to the electrostatic latent image, an electric field is generated in such a direction that negatively charged toner will be transferred (for developing) from the developing roller 11 at a potential difference (developing contrast) of 250 V. On the other hand, with respect to the background portion, an electric field is generated in such a direction that the toner will be attracted to the developing roller 11 at a potential difference (contrast removing fog) of 330 V. Therefore, that part of the residual toner on the photosensitive drum 1 which is located in the electrostatic latent image portion remains on the electrostatic latent image eventually while that part of the residual toner which is located in the background portion is transferred to the developing roller 11 by the contrast removing fog described above and collected eventually.

In the abutting nip between the photosensitive drum 1 and developing roller 11, the residual toner on the photosensitive drum 1 is collected into the developing roller 11 with its history disturbed into an unidentifiable pattern under the action of the mechanical rubbing produced by the speed difference from the developing roller 11 driven at a higher peripheral speed than the photosensitive drum 1.

Besides, the abutting nip desirably has a width of 0.5 to 5 mm, and ideally, 1 to 3.5 mm. If the nip width is less than 1 mm, it becomes difficult to provide uniform abutment and the duration of abutment is shortened, resulting in insufficient disturbance of the history of residual toner. This is undesirable. On the other hand, if the nip width exceeds 5 mm, excessive rubbing may produce rubbing marks on the developed toner image. This is also undesirable.

Figure 4:
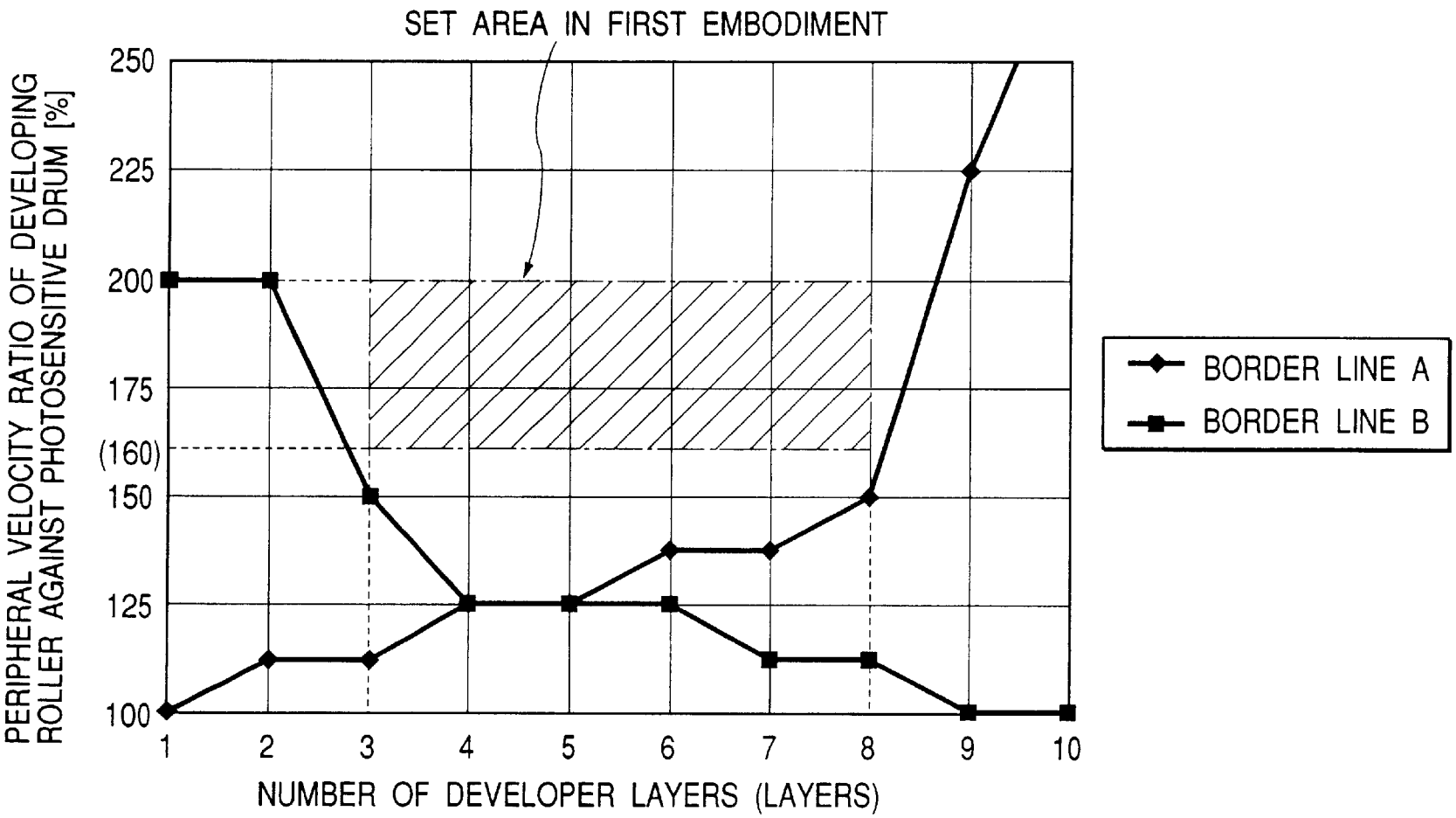
FIG. 4 is a graph showing the number of the developers layers carried on the developing roller, peripheral velocity ratio of the developing roller against the photosensitive drum, and allowable ranges of image fog and ghosts according to the first embodiment.

FIG. 4 summarizes the relationship between image fog and ghosts and the thickness of the developer layers carried on the developing roller, in the present image forming apparatus. It shows the changes in the image fog and ghosts when the number of the developer layers and peripheral velocity ratio of the developing roller against the photosensitive drum are varied. Both image fog and ghosts fall within the allowable ranges, in the area above the borderline A and in the area above the borderline B, respectively, while they fall out of the allowable ranges, in the area below the respective borderlines. In short, the area above both borderlines allows good image formation with the image fog and ghosts falling within the allowable ranges.

To supplement the explanation about FIG. 4, it can be seen that the allowable range for image fog is reduced as the developer layers become thicker and peripheral velocity ratio of the developing roller against the photosensitive drum becomes larger. This is because the thicker the developer layers become, the larger the amount of uncharged toner and reverse toner carried without sufficient frictional electrification with the developing roller or regulating blade. Besides, since increase in the peripheral velocity ratio of the developing roller results in increase in the amount of developer transported to the area of abutment against the photosensitive drum in a unit time, image fog will increase accordingly if the developer contains fog-causing toner.

The present image forming apparatus does not produce image fog in excess of the allowable ranges because it has been configured to form 3 to 8 thin layers of developer, charging the carried toner sufficiently.

As described above, ghosts tend to worsen with a decrease in the thickness of developer layers if the peripheral velocity ratio is kept constant. However, it falls within the allowable range in the area where the peripheral velocity ratio of the developing roller exceeds 150%. This area includes the 160 to 200% range, which is the peripheral velocity ratio of the developing roller for the present image forming apparatus. This is because the history of the residual toner is disturbed into an unidentified pattern due to a configuration in which the developing roller and the developer carried by it rub the residual toner on the photosensitive drum and also because the efficiency of rubbing has been improved by the peripheral velocity ratio of the developing roller exceeds 150%.

Furthermore, the use of 3 to 8 thin developer layers is also meaningful.

If the number of developer layers is less than 3, most toner comes into direct contact with the surface of the developing roller, covering the entire surface. Therefore, when collecting residual toner from the abutting nip, the residual toner is not carried directly on the surface of the developing roller, being obstructed by the toner carried earlier. It is often collected, lying on top of the carried toner. This makes it difficult to disturb the history by means of rubbing.

In contrast, if the number of developer layers is 3 or more, since the developer carried on the surface of the developing roller forms a few toner layers that are piled up on the base toner layer which contacts directly and covers the surface of the developing roller, the residual toner is collected by being rubbed in the abutting nip and taken into these toner layers. A large rubbing force acts on the residual toner collected in this state when it is taken into the carried toner layers. And when the residual toner is taken in and mixed, its history is disturbed greatly.

However, if the developer forms too may layers, the toner in the upper layers of the developer carried by the developing roller becomes distant from the surface of the developing roller, resulting in sharply reduced binding force with respect to the developing roller and thus making it difficult to provide sufficient binding. Therefore, the upper layers cannot follow the rotation of the developing roller during the rubbing by the developing roller, which reduces the rubbing force acting in real terms and lowers its effect.

Thus, the present image forming apparatus reduces image fog and produces the disturbance effect described above, by using 3 to 8 thin layers of developer. This disturbance effect is produced by rubbing which in turn is generated by the relative speed difference between the photosensitive drum and developing roller, so it is enhanced by setting peripheral velocity ratio of the developing roller against the photosensitive drum at 160 to 200%.

10,000 image forming operations were run on the present image forming apparatus with the photosensitive drum driven at a peripheral velocity of 75 mm/sec and the developing roller driven at a peripheral velocity of 120 mm/sec or at a peripheral velocity ratio of 160% against the photosensitive drum and good image formation was maintained with both image fog and ghosts falling within the allowable ranges.

Embodiment 2

Figure 6:
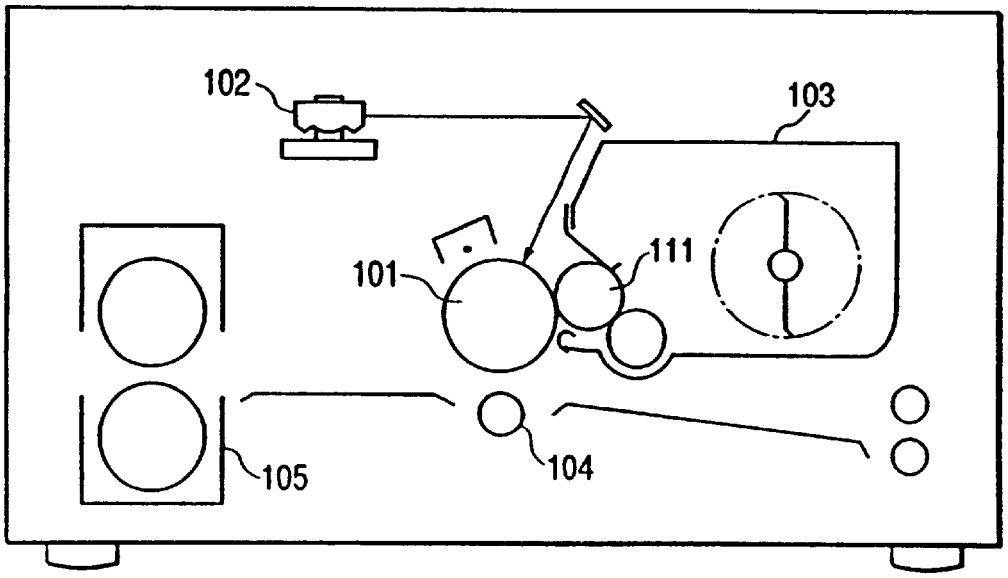
FIG. 6 PRIOR ART
FIG. 6 is a schematic block diagram showing an example of a conventional image forming apparatus.

The second embodiment of the present invention will be described with reference to FIG. 6.

The image forming apparatus according to this embodiment is based on the image forming apparatus of the first embodiment and uses a developer employing a spherical toner with good transferability to speed up image formation. Since its basic configuration is the same as that of the image forming apparatus of the first embodiment, only distinctive differences will be described below.

With the image forming apparatus according to this embodiment, the image formation speed, i.e., the drive speed of the photosensitive drum 101 is 100 to 250 mm/sec in terms of peripheral speed. Being placed in contact with the photosensitive drum 101, the developing roller 111 in the developing device 103 operates at 160 to 225% the peripheral speed of the photosensitive drum to form toner images by reversal developing.

This image forming apparatus uses a one-component developer consisting of a negatively chargeable, nonmagnetic, spherical toner, which has been made spherical for good transferability by a publicly known suspension polymerization process and which has acquired a low melting point and low softening point by enclosing a substance with a low melting point. Of course, a spherical toner produced by any other process may be used.

This toner has a volumetric average diameter of 4 to 7 $\mu$m to the advantage of image quality. This is because to reproduce minute electrostatic latent images recorded at a pixel density exceeding approximately 400 dpi, it is necessary to use a toner with a particle size in volume average of 10 $\mu$m at the most. In the case of images formed by a toner with a particle size in volume average of 7 $\mu$m or less, in particular, particle shape, uniformity, and other noises become difficult to percept, being driven into low-sensitivity areas in the visual sensation of human viewers. However, toner particle size in volume averages less than 4 $\mu$m are not desirable because they tend to produce a lot of transfer-residual toner particles on the photosensitive drum and transferring material due to lowered transfer efficiency as well as to cause non-uniform images dues to incomplete transfer. On the other hand, particle size in volume averages exceeding 10 $\mu$m tend to result in fusion of toner particles to the photosensitive drum surface and various members. This tendency becomes prominent if the coefficient of variation in the number distribution of toner particles exceeds 35%.

The coefficient A of variation in the number distribution of toner particles is given by the following equation.

$$\text{Coefficient of variation: } A=[S/D_1]\times 100$$

where S is the standard deviation of the number distribution of toner particles and $D_1$ is the particle diameter in number average ($\mu$m) of the toner particle.

This toner has a so-called core/shell internal structure consisting of a substance with a low softening point serving as the core and coated with a shell resin by means of polymerization.

The substance with a low softening point used as the core has the maximum heat absorption peak in the 40 to 130 degree C. range on a DSC curve measured with a differential scanning calorimeter during heat-up. The maximum heat supply peak temperature was measured in accordance with "ASTM D 3418-8" using DSC-7 manufactured by Perkin-Elmer Corp. The detecting element of the equipment is corrected for temperature by using the melting points of iridium and zinc, and corrected for heat quantity by using the heat of fusion of iridium. The sample is placed on an aluminum pan and an empty pan is used as a control. The temperature is raised and lowered once to record the history and then measurements are taken at a heat-up rate of 10° C./min. The substances that have the maximum heat absorption peak in the temperature range described above contribute greatly to low-temperature fixing and display effective release characteristics. This eliminates the need to apply a release agent such as silicon oil and thus allows the configuration of the fixing apparatus to be simplified.

Specifically, the substances with a low softening point described above include paraffin wax, polyolefin wax, Fischer-Tropsch wax, amide wax, higher fatty acids, ester wax, their derivatives, and their graft/block compounds. Preferably 5 to 30% of such a substance should be added to the toner.

Preferably, the toner particles observed through a transmission electron microscope (TEM) should provide a sectional view showing the wax component dispersed in a substantially spherical and/or spheroidal island shape in a state insoluble with the binder resin. By dispersing and enclosing the wax component within the toner in the manner described above, it is possible to effectively prevent the deterioration of the toner and soiling of the image forming apparatus, so that the toner can retain good chargeability and can provide toner images with excellent dot reproducibility for an extended period of time. Besides, the wax component operates effectively during heating, providing improved low-temperature fixability and anti-offset characteristic.

The characteristic internal structure of the toner particles can be identified through observation of their cross sections. Specifically, they are observed as follows. Toner particles are dispersed well in a cold-setting epoxy resin, which is then allowed to harden at 40° C. for 2 days. The hardened product is dyed with triruthenium tetroxide, or in combination with triosmium tetroxide as required, and sliced into thin flakes by a microtome having a diamond cutter. The resulting flaky sample is observed through a transmission electron microscope (TEM) to confirm the sectional structure of toner particles. The use of the triruthenium tetroxide dye is preferable to provide a contrast between the wax component and resin shell by utilizing a slight difference in crystallinity between them. It was observed that the toner particles had their wax component enclosed in the outer shell resin.

Preferably the toner should have a shape factor SF-1 of 100 to 160 and a shape factor SF-2 of 100 to 140 as measured by an image analyzer. More preferably the shape factor SF-1 should be 100 to 140, and the shape factor SF-2 should be 100 to 120. If the above conditions are satisfied and the value of (SF-2)/(SF-1) is 1.0 or less, an extremely good match with the image forming apparatus will be obtained in addition to excellent toner characteristics.

The shape factors SF-1 and SF-2 used in the present invention were defined as follows. Toner images were magnified 500 times by FE-SEM (S-800) manufactured by Hitachi, Ltd., and 100 of them were sample at random. The resulting image information was input through an interface into an image analyzer (Luzex 3) manufactured by Nicolet Japan Corporation. The values calculated with the following equations were defined as the shape factors SF-1 and SF-2 in the present invention.

$$SF\text{-}1=\{(\mathrm{MXLNG})^2/\mathrm{AREA}\}\times(\pi/4)\times 100$$

$$SF\text{-}2=\{(\mathrm{PERI})^2/\mathrm{AREA}\}\times(1/4\pi)\times 100$$

(MXLNG: maximum length; AREA: projection area of toner; and PERI: perimeter)

The shape factor SF-1 represents the roundness of toner particles. As the value increases, the shape changes from spherical to indefinite. The shape factor SF-2 represents the surface irregularity of toner particles. A large SF-1 value causes the toner to assume indefinite shape, similarly. This makes the charge distribution broader and the toner surfaces liable to be ground within the developing apparatus, contributing to low image density and image fog.

To achieve high transfer efficiency, the shape factor SF-2 of toner particles should be 100 to 140 and the value of (SF-2)/(SF-1) should be 1.0 or less. If the shape factor SF-2 of toner particles is larger than 140 and the value of (SF-2)/(SF-1) exceeds 1.0, the surfaces of the toner particles are not smooth, but tend to have a lot of surface irregularities, resulting in lowered efficiency of transfer from the photosensitive drum to transfer paper and the like.

To supplement the explanation about the toner shapes and transferability described above, the forces acting on toner particles and the like include electromagnetic forces such as the mirror image force which is a main force and acts on the charge of the toner itself, other Van der Waals forces, and physical forces represented by the cross-linking force of liquid produced by the drops of the liquid clinging to surfaces. These forces acting on the toner are relatively large on a microscopic scale on and near the surfaces of the toner. For example, in the case of toner that has indefinite shape, it has been observed that adhesion varies depending on the condition of contact with the counterpart. This may be explained by the fact that the adhesion (electromagnetic force) of toner having indefinite shape varies due to dispersion in the surface density of charge (e.g., local increase of charge density in protrusions) in various parts of the toner. Therefore, the developer consisting of a toner of indefinite shape does not necessarily behave uniformly in a uniform electric field. A concrete manifestation of this phenomenon is transferability. That is, if toner has indefinite shape, it is difficult to obtain high transferability because not all its particles are transferred in accordance with the electric field.

In contrast, toner of a spherical shape tends to have a uniform distribution of surface charge density because of its shape and thus has a small dispersion in adhesion. Therefore, it is readily transferred uniformly in accordance with the transfer electric field, resulting in high transferability.

Considering the above points, the present image forming apparatus uses a toner with a proper sphericity to achieve good transferability. This reduces history itself and thus is effective in suppressing ghost. In addition, since the absolute amount of residual toner left on the photosensitive drum is reduced, it is possible to reduce the amount of toner that undergoes functional deterioration under the load involved in the sequence of image formation processes and is accumulated in the developing device without being reused.

Therefore, good image formation can be maintained even at an image formation speed as high as 100 to 250 mm/sec, as is the case with the present image forming apparatus, and the life of the apparatus can be prolonged.

Also, a publicly known flowability producer, lubricant, abradant, cleaning assistant, resistance modifier, and/or charge control agent can be added externally to this toner as required. Preferably the coverage of external additives should be 5 to 99%, and more preferably 10 to 99%.

The coverage of external additives is defined as follows.

100 toner images were sampled at random using FE-SEM (S-800) manufactured by Hitachi, Ltd. The image information was input through an interface into an image analyzer (Luzex 3) manufactured by Nicolet Japan Corporation. The resulting image information was binarized by utilizing the difference in brightness between toner particle surfaces and external additives, the area SG of the external additives and area (including the area of external additives) ST of the toner particles were determined, and the coverage of external additives was defined using the following equation.

$$\text{Coverage of external additives } (\%)=(SG/ST)\times 100$$

Preferably, the particle size in volume average of external additives should be equal to or less than 1/10 of the weight average diameter of the toner particle, considering their durability when they are added to the toner. The particle size in volume average of external additives is the average particle size in volume average determined through microscopic observation of toner particle surfaces.

Specifically, available external additives include metal oxides (aluminum oxide, titanium oxide, strontium titanate, cerium dioxide, magnesium oxide, chromium oxide, tin oxide, zinc oxide, etc.), nitrides (silicon nitride), carbides (silicon carbide), metal salts (calcium sulfate, barium sulfate, calcium carbonate, etc.), metal salts of fatty acids (zinc stearate, calcium stearate, etc.), carbon black, silica, etc.

Preferably 0.01 to 10 weight parts of external additives, and more preferably 0.05 to 5 weight parts, should be added to 100 weight parts of toner particles. The external additives can be used individually or in combination. More preferably, they should be subjected to hydrophobic treatment.

Figure 5:
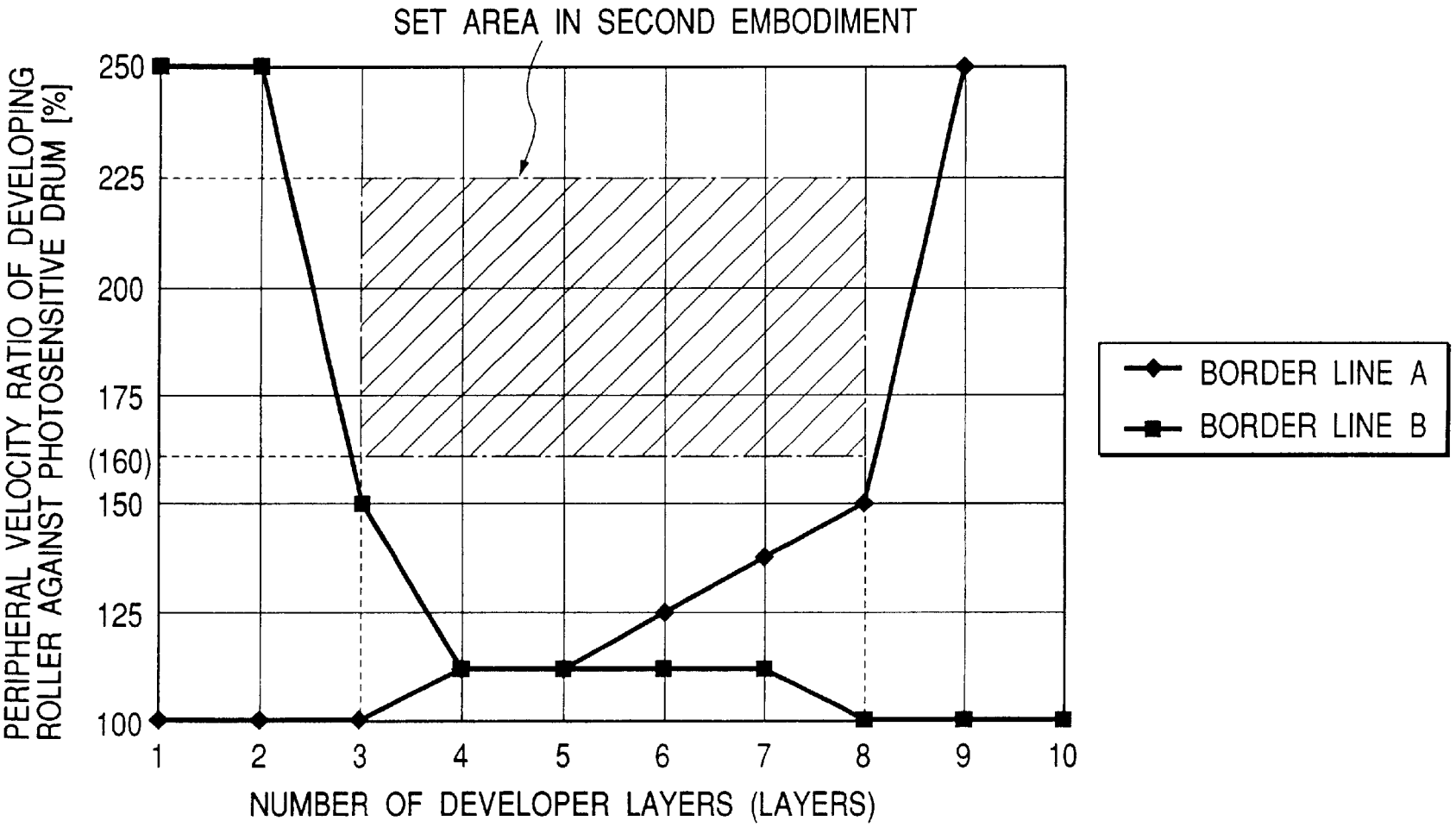
FIG. 5 is a graph showing the number of the developer layers carried on the developing roller, peripheral velocity ratio of the developing roller against the photosensitive drum, and allowable ranges of image fog and ghosts according to a second embodiment.

FIG. 5 summarizes the relationship between image fog and ghosts and the thickness of the developer layers carried on the developing roller, in the present image forming apparatus. It shows the changes in the image fog and ghosts when the number of the developer layers and peripheral velocity ratio of the developing roller against the photosensitive drum are varied. Both image fog and ghosts fall within the allowable ranges, in the area above the borderline A and in the area above the borderline B, respectively while they fall out of the allowable ranges, in the area below the respective borderlines. In short, the area above both borderlines allows good image formation with the image fog and ghosts falling within the allowable ranges.

Adding some explanation about the ghosts in the figure, it can be seen that the area representing the allowable range is narrower than that of the first embodiment when there are less than three layers of developer. This is attributable to the use of spherical toner. Because of its spherical shape, the spherical toner can readily be packed closely when applied as thin layers and has good rolling characteristic. Therefore, when there are less than three layers of developer, the entire surface of the developing roller is covered with the toner more densely than in the case of the first embodiment. Consequently, the residual toner to be collected is difficult to be taken into the developer layers carried earlier and a disturbance effect is difficult to be produced. Also, because of the good rolling characteristics, the actual rubbing force does not increase much even if, for example, the peripheral velocity ratio of the developing roller is increased so much that the developing roller rubs the abutting nip. Hence, the phenomena described above are observed.

However, with the present apparatus, since the developer carried on the developing roller is formed into predetermined 3 to 8 thin layers, the history of residual toner can be disturbed sufficiently by taking the residual toner into the developer layers and mixing it.

That is because in this predetermined thin layer configuration, the developer layers constitute stacked layers of toner, as described above, where the surface layer of the developer layers is not necessarily fully filled with toner, but has voids which the residual toner can enter. Besides, because of the good rolling characteristics of spherical toner described above, residual toner enters the developer layers by forcing the toner carried earlier to roll out of them. The toner forced out is transferred and fills the voids, thereby bringing about the closest-packed state. Consequently, the residual toner is bound to the developing roller tightly. Therefore, a rubbing force as strong as in the case of the first embodiment is applied on the residual toner, producing a marked history disturbance effect.

Furthermore, if the number of developer layers exceeds 8, the toner in the upper layers of the developer carried by the developing roller becomes distant from the surface of the developing roller, resulting in sharply reduced binding force with respect to the developing roller and thus making it difficult to provide sufficient binding. Therefore, the upper layers cannot follow the rotation of the developing roller during the rubbing by the developing roller. In addition, due to the good rolling characteristics, the displacement between the toner layers in the developer layers further reduces the rubbing force, resulting in insufficient disturbance effect.

In short, by forming the developer employing spherical toner into predetermined 3 to 8 thin layers, the present apparatus can produce the disturbance effect described above as well as reduce image fog.

20,000 image forming operations were run on the present image forming apparatus with the photosensitive drum driven at a peripheral velocity of 150 mm/sec and the developing roller driven at a peripheral velocity of 255 mm/sec or at a peripheral velocity ratio of 170% against the photosensitive drum and good image formation was maintained with both image fog and ghost falling within the allowable ranges.

Although the embodiments described above use a developer employing a nonmagnetic toner, the present invention can also be applied to developers employing magnetic toner and still produce similar effect and action.

Also, the present invention produces similar effect and action in any configuration in which images are formed by a one-component contact developing method using the cleaning process simultaneous with developing. Therefore, it can be freely applied to one-component contact developing methods that employ an elastic image bearing member such as an endless belt and a rigid developer carrying member.

As can be seen from the above description, with the image forming apparatus according to this embodiment, the one-component developer carried by the developer carrying member is formed into at least 3 to 8 thin layers and the image bearing member is rubbed, in the contact area, by the developer carrying member and the one-component developer carried by it, thereby disturbing the history of the one-component developer left on the developer carrying member. This result in reduction of image fog and ghosts and thus allows good image formation to be maintained for an extended period of time.

The toner in the one-component developer used by the image forming apparatus described above has a shape factor SF-1 of 100 to 160 and a shape factor SF-2 of 100 to 140. This makes it possible to speed up image formation and prolong the life of the apparatus while maintaining good image formation.

What is claimed is:

1. An image forming apparatus, comprising:

an image bearing member for bearing an electrostatic latent image; and developing means for developing the electrostatic latent image with a developer and colleting the developer remaining on said image bearing member including:

a developer carrying member for carrying the developer, wherein the developer carried by said developer carrying member comes into contact with said image bearing member as said developer carrying member moves; and a regulating member for regulating a layer thickness of the developer carried by said developer carrying member, wherein said regulating member regulates the layer thickness of the developer carried by said developer carrying member so that there will be three to eight layers, wherein $V2/V1>1.54$ holds where V1 is a peripheral velocity of said image bearing member and V2 is a peripheral velocity of said developer carrying member.

2. An image forming apparatus according to claim 1, wherein the developer is a one-component developer.

3. An image forming apparatus according to claim 2, wherein the one-component developer has a shape factor SF-1 of 100 to 160 and a shape factor SF-2 of 100 to 140.

4. An image forming apparatus according to claim 3, wherein at a contact portion between the developer borne by said developer carrying member and said image bearing member, said developer carrying member and said image bearing member rotate in a same direction.

5. An image forming apparatus according to claim 3, wherein a value obtained by dividing the shape factor SF-2 of the one-component developer by the shape factor SF-1 thereof is equal to or less than 1.0.

6. An image forming apparatus according to claim 5, wherein at a contact portion between the developer borne by said developer carrying member and said image bearing member, said developer carrying member and said image bearing member rotate in a same direction.

7. An image forming apparatus according to claim 2, wherein at a contact portion between the developer borne by said developer carrying member and said image bearing member, said developer carrying member and said image bearing member rotate in a same direction.

8. An image forming apparatus according to claim 1, wherein said developer carrying member and said image bearing member rotate in directions opposite to each other.

9. An image forming apparatus according to claim 1, wherein the ten-point average roughness Rz on a developer carrying surface of said developer carrying member is 5 to 10 $\mu$m and the maximum height Rmax is 15 $\mu$m or less.

10. An image forming apparatus according to claim 9, wherein at a contact portion between the developer borne by said developer carrying member and said image bearing member, said developer carrying member and said image bearing member rotate in a same direction.

11. An image forming apparatus according to claim 1, wherein at a contact portion between the developer borne by said developer carrying member and said image bearing member, said developer carrying member and said image bearing member rotate in a same direction.

12. An image forming apparatus according to claim 1, wherein said developer carrying member abuts against said image bearing member.

* * * * *

UNITED STATES PATENT AND TRADEMARK OFFICE

CERTIFICATE OF CORRECTION

PATENT NO. : 6,389,253 B1 
DATED : May 14, 2002
INVENTOR(S) : Makoto Nonomura et al.

It is certified that error appears in the above-identified patent and that said Letters Patent is hereby corrected as shown below:

Column 1,
Line 10, “related” should read -- relates --;
Line 24, “simultaneous” should read -- simultaneously --; and
Line 48, “not shown.” should read -- (not shown). --.

Column 2
Line 21, “si” should read -- is --; and
Line 46, “not shown” should read -- (not shown) --.

Column 3,
Line 41, “the performing” should read -- performing the --; and
Line 43, “applied” should read -- applied to --.

Column 4,
Line 12, “BREIF” should read -- BRIEF --;
Line 19, “a potentials” should read -- the potentials --; and
Line 22, “developers” should read -- developer --.

Column 6,
Line 57, “simultaneous” should read -- simultaneously --.

Column 7,
Line 15, “being” should read -- height --;
Line 19, “Ltd.)” should read -- Ltd.). --; and
Line 25, “simultaneous” should read -- simultaneously --.

Column 9,
Line 8, “rubbing” should read -- rubbing, which --; and
Line 9, “roller” should read -- roller, --.

Column 10,
Line 21, “percept,” should read -- perceive, --;
Line 26, “dues” should read -- due --;
Line 33, “equation.” should read -- equation: --; and
Line 38, “particle.” should read -- particles. --.

UNITED STATES PATENT AND TRADEMARK OFFICE

CERTIFICATE OF CORRECTION

PATENT NO. : 6,389,253 B1 
DATED : May 14, 2002
INVENTOR(S) : Makoto Nonomura et al.

It is certified that error appears in the above-identified patent and that said Letters Patent is hereby corrected as shown below:

Column 11,
Line 41, “sample” should read -- sampled --.

Column 12,
Line 31, “ghost.” should read -- ghosts --.

Column 14,
Line 15, “ghost” should read -- ghosts --;
Line 24, “simultaneous” should read -- simultaneously --;
Line 36, “result” should read -- results --; and
Line 51, “colleting” should read -- collecting --.

Signed and Sealed this

Thirtieth Day of July, 2002

*Attest:*

*Attesting Officer*

JAMES E. ROGAN
*Director of the United States Patent and Trademark Office*